United States Patent [19]

Kals

[11] 4,273,733

[45] Jun. 16, 1981

[54] APPARATUS FOR COOLING FLUIDS

[75] Inventor: Walter Kals, Hastings-on-Hudson, N.Y.

[73] Assignee: Niagara Blower Company, New York, N.Y.

[21] Appl. No.: 61,725

[22] Filed: Jul. 30, 1979

[51] Int. Cl.[3] ..... F28D 5/02

[52] U.S. Cl. ..... 261/151; 62/314; 137/875; 261/153

[58] Field of Search ..... 261/151, 153; 98/121 A; 137/875; 62/314

[56] References Cited

U.S. PATENT DOCUMENTS

| | | | |
|---|---|---|---|
| 2,123,742 | 7/1938 | Offen | 261/151 |
| 2,204,012 | 6/1940 | Cook | 62/314 |
| 2,296,946 | 9/1942 | Olstad et al. | 261/151 |
| 2,321,933 | 6/1943 | Olstad et al. | 261/151 |
| 2,379,932 | 7/1945 | Schoepflin | 261/151 |
| 2,445,199 | 6/1948 | Williams | 62/314 |
| 2,570,247 | 10/1951 | Kals | 261/151 |
| 2,661,933 | 12/1953 | Deverall | 261/151 |
| 2,693,247 | 11/1954 | Olstad et al. | 261/151 |
| 2,852,090 | 9/1958 | Kelley | 261/151 |
| 2,859,946 | 11/1958 | Boyle et al. | 62/314 |
| 2,881,853 | 4/1959 | Kelley | 261/151 |
| 3,147,773 | 9/1964 | Matthews et al. | 137/875 |
| 3,148,516 | 9/1964 | Kals | 261/151 |
| 3,174,709 | 3/1965 | Alderson | 137/875 |
| 3,266,553 | 8/1966 | Munters | 261/151 |
| 3,759,056 | 9/1973 | Graber | 98/121 A |
| 3,771,559 | 11/1973 | Alley | 98/121 A |
| 3,785,121 | 1/1974 | Phelps | 261/151 |
| 3,881,516 | 5/1975 | Childers et al. | 137/875 |
| 3,897,773 | 8/1975 | Burt et al. | 137/875 |
| 4,122,612 | 10/1978 | Mrofchak | 137/875 |

*Primary Examiner*—Tim R. Miles

*Attorney, Agent, or Firm*—Hosier, Niro & Daleiden

[57] ABSTRACT

This invention relates to an apparatus for maintaining the desired temperature of a fluid, or more specifically, to reducing the temperature of the fluid to a desired level. The apparatus generally relates to one including a heat exchange coil through which the fluid to be cooled passes and over which an air stream is moved to absorb heat from the coil. In such an arrangement, it is common to increase the heat transfer efficiency of the coil by maintaining the same in a wet condition by means of a water spray or cascade, for example. In this manner, evaporation of the water causes an accelerated transfer of heat from the fluid in the coil for a given amount of air flow thereover than would be the case if the coil surface was not drenched. The present invention is directed to the disposition of a propeller air moving means sufficiently downstream of the cooling coil so as to be substantially free of air flow obstructions. In addition, the usefulness and efficiency of the apparatus is improved by the inclusion of a novel air recirculation damper having an air foil configuration which is pivoted about its trailing edge.

25 Claims, 10 Drawing Figures

FIG. 1
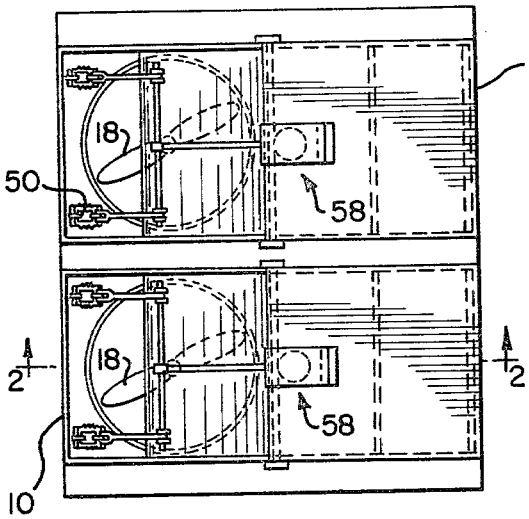
FIG. 4
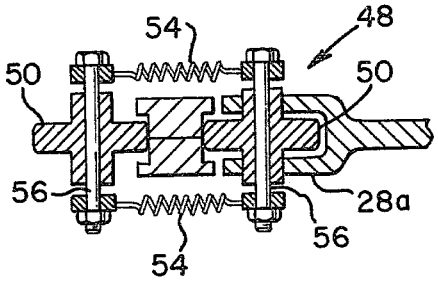
FIG. 2
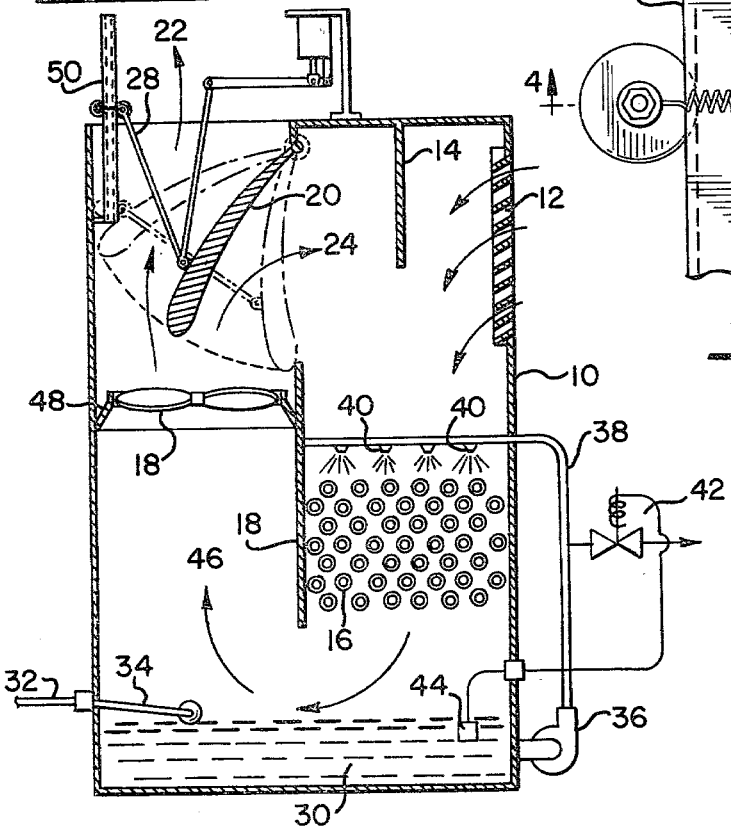
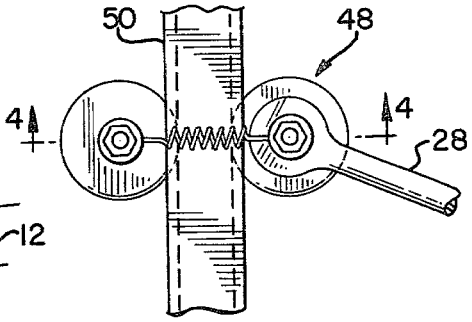
FIG. 3

APPARATUS FOR COOLING FLUIDS

BACKGROUND OF THE INVENTION

This invention relates to apparatus for maintaining the desired temperature of a fluid, and more particularly, is shown as an example of its use, as embodied in a heat exchanger for reducing and maintaining the temperature of a fluid to a desired level. Specifically, the present invention relates to a wet surface, air cooled heat exchanger wherein an air moving means induces an air flow over a heat exchange element such as a tube bundle or coil through which the fluid to be cooled passes.

An air cooled heat exchanger consists generally of a tubular heat transfer surface and a fan. The fluid passing through the tubes surrenders heat to air propelled by the fan over the external tube surface. The heat energy of air passing over the tubes increases in the same amount as the heat energy loss by the fluid, when assuming that no other heat losses occur. As known to those skilled in the art, a reduction of the air mass passing over the heat transfer surface will reduce the amount of absorbed heat by a proportionate amount. Therefore, the cooling capacity can be controlled by varying the air mass passing over the tubular heat transfer surface.

It is known to vary the air mass passing over a heat transfer surface by, for example, reducing the speed of an air moving fan or by decreasing the pitch of the propeller blades of a fan, if propeller fans are utilized. The air mass flow could also be throttled by a damper, for example.

It is also possible to vary the heat transmission rate from the heat transfer surface by returning a portion of the exhausted air which has passed over the heat transfer surface to the heat transfer surface again, while commensurately reducing the air entering from the outdoors, for example, by the amount of air which is returned or recirculated. A reduction in the recirculated air, as well known in the art, will increase the amount of heat surrendered to the air in a proportionate manner. Accordingly, the cooling capacity can be also controlled by varying the amount of recirculated exhaust air, while keeping the air mass passing over the heat transfer surface generally constant. This method is known as capacity control by proportioned air recirculation.

In order to achieve capacity control by proportioned air recirculation, known practices require a system of coordinated dampers to vary the amount of air to be exhausted, the amount of air to be recirculated and the amount of fresh outside air to be combined with the recirculated air for passage over the heat transfer surface. Of course, the use of multiple dampers results in considerable air turbulence and a resulting reduction in efficiency of the entire apparatus.

U.S. Pat. Nos. 2,296,946; 2,321,933 and 2,445,199 are exemplary of recirculation arrangements including multiple dampers. The dampers at the fresh air inlet and exhaust outlet ports must function in unison and their positions must be inversely proportional to the position of the damper at the recirculation port, the dampers in all three ports to open and close in a coordinated manner. Thus, if the fresh air inlet and exhaust outlet were wide open, the air return or recirculation means would be closed and, of course, if the air inlet and exhaust openings were closed, the recirculation duct would be open. The present invention is concerned with the use of a single damper blade in lieu of multiple damper blades to achieve proportioned air recirculation, with greater simplicity of design and dependability of operation.

The prior art has also considered various means or, more specifically, linkages for operably positioning multiple damper assemblies and single damper assemblies, an example of the latter being disclosed in U.S. Pat. No. 2,379,932. All of the dampers used in the type of apparatus referred to are subjected to various degrees of buffeting by the air impinging thereagainst. The configuration of the damper disclosed by the present invention substantially reduces buffeting and corresponding turbulence. Most importantly, this damper will be entirely out of the air stream whenever all air is exhausted for maximum capacity. In this regard, the present invention is also concerned with a unique, pneumatically actuated linkage system for positioning the damper of the present invention.

Another substantial problem encountered in prior art air cooled heat exchangers involves the fact that the same discharge air upwardly into the atmosphere to dissipate the absorbed heat. This practice has been undertaken with a view towards allowing the heat-laden air stream to follow a natural updraft path. However, in order to recirculate a portion of the exhaust or discharge air, it must then be channelled from a point above the heat transfer surface to a point below it. With the admission of fresh outside air below the heat transfer surface, the same must be proportionately reduced by a damper in the same measure as the amount of recirculation air increases. Necessarily, a failure to do so would cause excess outside air to be admitted below the tubular surface by a natural updraft of air past such surface, possibly aided by wind blowing against the fresh air inlet opening. Such excess outside air would then escape at the air discharge. The updraft of excess outside air past the heat transfer surface is particularly undesirable if no cooling is required, and the air moving means has been stopped. For example, such exposure to a potential updraft of outside air would increase the possibility of damage from freezing. Therefore, known practices placing the heat transfer surfaces in a natural updraft depend on a damper at the fresh air inlet below the heat transfer surface. This measure has only a limited effectiveness since the natural air updraft promotes the entrance of outside air by leakage.

Furthermore, it is known practice to discontinue wetting the heat transfer surface in cold weather when all air passing over the heat transfer surface is recirculated, and the air moving means is stopped. However, such periodic interruption of wetting the heat transfer surface promotes the formation of scale as the minerals dissolved in the wetting water dry on the metallic heat transfer surface.

In contrast, the disclosed arrangement, having only a single damper blade to recirculate a portion or all of the exhaust air does not promote the passage of cold outside air over the heat transfer surface by a natural updraft and does not require an additional coordinated damper at a fresh outside air inlet. In addition, a massive drenching of the heat transfer surface does not have to be interrupted in sub-freezing weather.

The present invention is also concerned with the use of a propeller fan as an air mover for recirculated and fresh outside air passing over a heat transfer surface. It is known in the prior art to utilize propeller fans generally for this purpose as, for example, illustrated in U.S. Pat. No. 2,379,932 to Schoepflin et al. However, in the Schoepflin et al. arrangement, the heat transfer surface is disposed immediately downstream of a propeller fan so as to disturb the normal flow pattern of air from the propeller fan—the flow of air discharged by a propeller fan being normally directed towards the fan axis. Necessarily, such disturbance to the propeller air flow presents a substantial inefficiency. Such inefficiency is of increasing concern when large air volumes are involved.

SUMMARY OF THE INVENTION

Accordingly, a primary object of the present invention is to provide a heat transfer apparatus utilizing a propeller fan means to be associated with substantially reduced turbulence compared to prior art arrangements which will thereby improve the fan efficiency.

Another object of the present invention is to prevent exposure of the heat transfer surface considered herein to a relatively cold outside air updraft when the fan means has been stopped.

A further object of the present invention is to provide the aforesaid heat transfer apparatus with a single damper of an air foil configuration for proportioning discharge and recirculation air through the apparatus.

Still another object of the present invention is to provide the aforesaid heat transfer apparatus wherein an uninterrupted water cascade over the heat transfer surface in sub-freezing weather may be provided.

In summary, the present invention provides an air cooled heat transfer apparatus having, in a preferred embodiment, a drenched heat transfer surface. A propeller fan means is disposed in a downstream portion of the air duct through the apparatus. The propeller fan is operative to draw a stream of air through the air duct and across the drenched heat transfer surface. The air duct is substantially free of flow restrictions downstream of the propeller so that the efficiency thereof is maximized since it operates against a relatively low static pressure.

In addition, the present invention discloses the use of a single air foil damper for proportioning air discharge and air recirculation. The air foil damper is pivoted about its trailing edge and may be accurately and firmly positioned by use of a combined linkage and pneumatic cylinder piston assembly.

In the disclosed embodiment, both the fresh air inlet and discharge outlet for air passing through the apparatus are disposed above the tubular heat transfer surface. In this regard, the admission of excess outside air is avoided by a baffle means, and the outside air which is admitted to the apparatus is always forced downwardly over the heat transfer surface whereby a natural updraft of outside air over the heat transfer surface cannot occur. Should no cooling be required and the propeller fan stopped after all air in the apparatus is recirculated, the apparatus is protected against freezing conditions. The foregoing and other objects, advantages, and characterizing features of the present invention will become clearly apparent from the ensuing detailed description of the following embodiment thereof, taken together with the accompanying drawings wherein like reference characters denote like parts throughout the various views.

FIG. 1 is a top plan view of a heat transfer apparatus embodying the present invention;

FIG. 2 is an elevational view, partly in section, taken about on line 2—2 of FIG. 1;

FIG. 3 is a detail view, with portions broken away, illustrating the guide for associated with the damper of the present invention;

FIG. 4 is a top view, partly in section, taken about on line 4—4 of the FIG. 3 with respect to the guide bar subassembly illustrated therein;

DETAILED DESCRIPTION OF PREFERRED EMBODIMENTS

Figure 5:
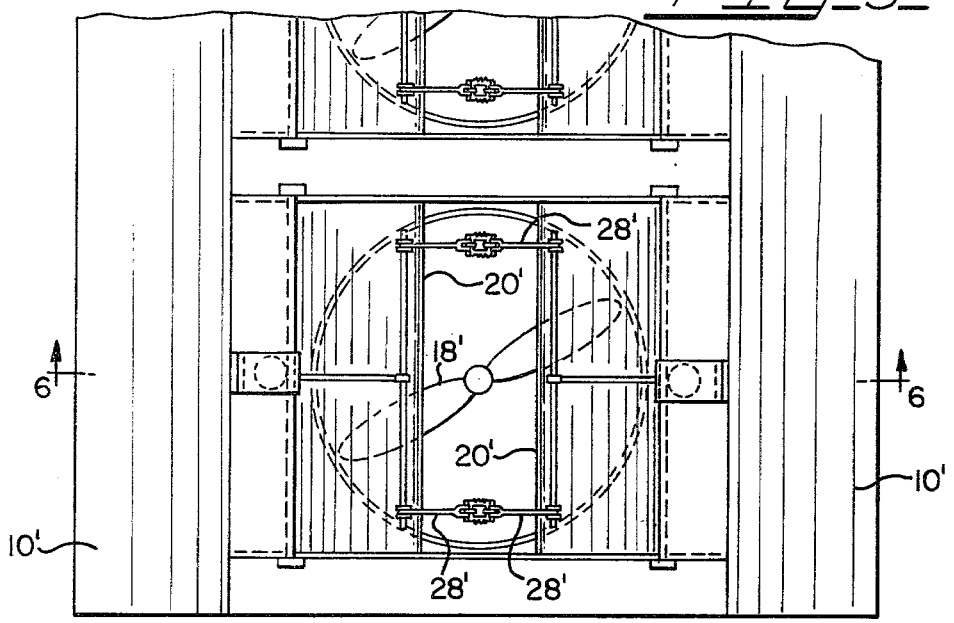
FIG. 5 is a top plan view of a dual module heat transfer apparatus which employs a common propeller fan means with respect to two separate heat transfer surfaces.

Referring to the illustrative embodiment depicted in FIGS. 1 and 2, there is shown side by side housings 10 for the heat transfer apparatus comprising the present invention. Each housing 10 defines an air duct means through the apparatus. The inlet to the air duct is through the fixed grate 12 whereby fresh incoming air is directed downwardly by baffle 14. The air duct is generally of U-shaped configuration passing downwardly through a first leg including cooling means 16. The air duct extends from cooling means 16 beneath barrier 18 and upwardly through the leg portion including a propeller fan means 18. The portion of the air duct downstream from propeller 18 includes a recirculation damper 20 in the form of an air foil which is pivoted about its trailing edge. Dependent on the position of air foil 20, the air flow downstream of propeller 18 may be entirely exhausted through the end of the air duct indicated at arrow 22, may be entirely recirculated through the air duct means as indicated at arrow 24 or may be selectively divided into exhaust and recirculation portions as considered hereinbelow. As more fully illustrated in FIGS. 9 and 10, the air foil damper 20 is positioned by a pneumatic cylinder and piston assembly 58 in combination with a lever arm 66 and connecting link 70. In addition, guide bars 28 control the pivoted movement of the damper about its trailing edge, all of which will be described in detail hereinbelow.

Incoming fresh air, and recirculated air 24, if any, pass over the tubular heat exchange surface 16. As well known in the art, the heat flux from the cooling means 16 to the air stream can be greatly accelerated when the tubular surfaces are maintained in a wet condition as by spraying. Accordingly, a reservoir of water 30 is provided in the base of housing 10, the level of which is controlled by supply line 32 and associated float control 34. Water from reservoir 30 is withdrawn by pump 36 and flows through conduit 38 and spray arrangement 40 to fall downwardly over the tube bundle. As indicated, water evaporated into the air stream is made up by a float operated valve arrangement 34. A "blow-down"

valve 42 opens intermittently whenever the concentration of solids dissolved in the water becomes too high as indicated by high electrical conductivity. This conductivity is measured by a probe 44 which provides appropriate signals to the "blow-down" valve 42.

The air stream passing upwardly through the air duct as indicated at arrow 46 flows towards propeller 18 in a substantially undisturbed manner. In this regard, propeller 18 is surrounded by a flow ring 48 which is proceeded by adjacent upstream air duct wall portions which are generally straight. As considered more fully hereinbelow, it is a principal feature of the present invention that the air flow through propeller 18 is substantially free of disturbances whereby the efficiency of the air flow system is maximized. In this regard, it is preferable that the entire length of the air duct include a cross-sectional area at least as great as the corresponding area of propeller flow ring 48 so that the flow to and from the propeller is not restricted by an undersized air duct.

When air foil 20 is in a vertical disposition, the upstream portion of the air duct adjacent propeller 18 is substantially straight and free of any flow restriction. As indicated, dependent on various operating parameters, the air foil 20 may be pivoted to selected positions between a fully opened and fully closed disposition with respect to exhaust portion 22 of the air duct. When in other than a vertical disposition, the air foil configuration of the damper 20 smoothly divides or redirects the air flow from propeller 18 so as to minimize any air flow disturbance. Since the air flow issuing from propeller 18 is initially directed toward the propeller axis and then outwardly from the axis, it would be most efficient with respect to the propeller to provide a hyperbolic air duct portion downstream from the propeller. However, it has been found that the substantially straight air duct walls provided downstream from the propeller when the air foil is in a vertical disposition provide a very viable alternative. Also, the air foil configuration of damper 20 operates to maintain a high level of propeller efficiency when the damper is in a raised disposition. In this regard, it is to be also understood that damper 20 develops a lift by the air flow over its upper surface when the exhaust portion 22 is at least partially open.

The guide bars 28 are pivotally connected to damper 20 at its lower end and are connected at its upper end to a roller means 48 for translational movement upwardly and downwardly along vertically disposed post 50 which is fixed relative to housing 10. As viewed in detail in FIGS. 3 and 4, roller means 48 comprises a yoke portion **28*a* on the end of guide bar 28 which is coupled to roller element 50 on the other side of post 50. Both rollers 50 are tied to one another by resilient spring means 54, the ends of which are journaled to pins 56** passing through the roller means.

Figure 9:
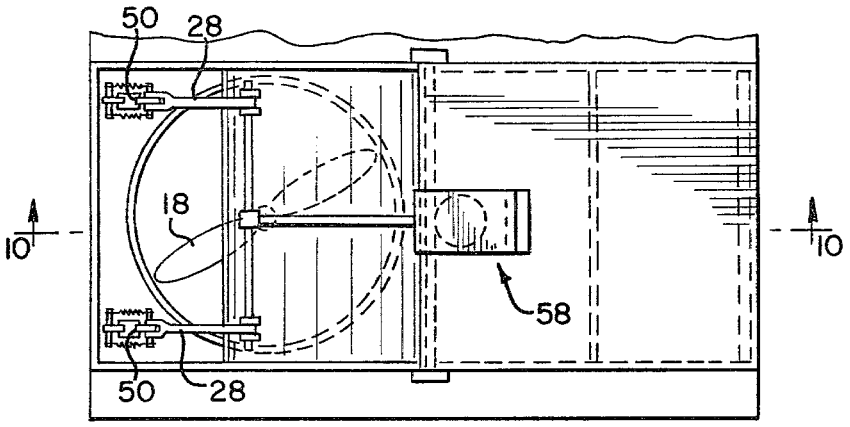
FIG. 9 is an employed top plan view of the damper actuating means and assembly for positioning the air foil damper of the present invention.
Figure 10:
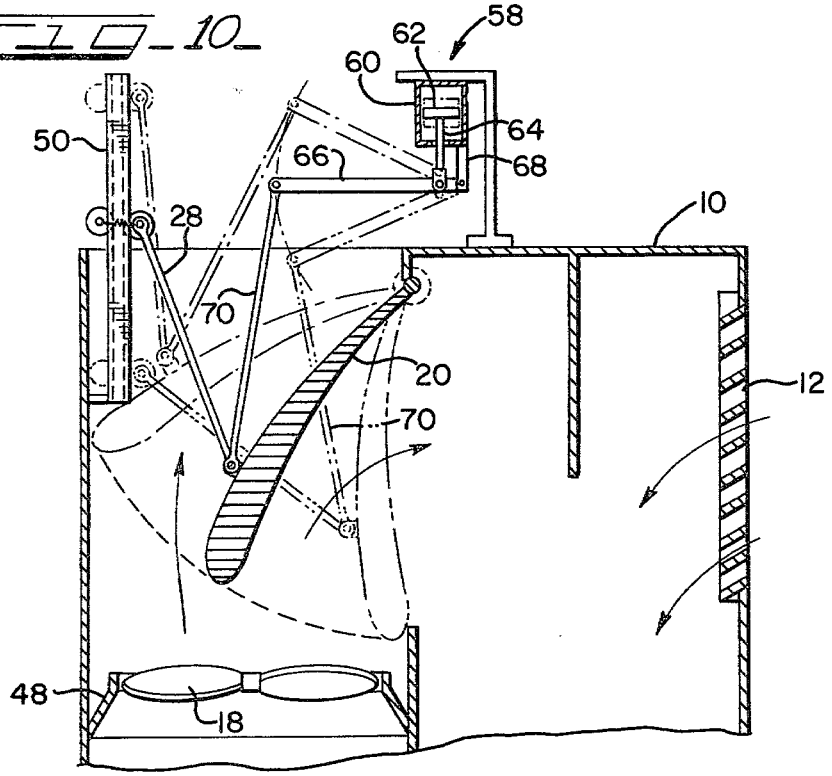
FIG. 10 is an elevational view, partly in section, taken about on line 10—10 of FIG. 9.

As shown in FIGS. 9 and 10, the actuating means 58 is provided for selectively pivoting damper 20 to various positions within the air duct means downstream of propeller 18. Guide bars 28, as described above, are pivotally connected to the air foil at one end while the other end of the guide bar translates upwardly and downwardly along the vertical guide post 50. A pneumatic cylinder 60 is provided which includes a piston means 62, having a relatively short stroke, and a connecting rod 64 which extends downwardly from piston 62. A lever arm or link 66 is provided to pivot about a fixed fulcrum point provided by strut 68 which is stationary with respect to housing 10. As viewed in FIG. 10, the lefthand end of the lever arm 66 is pivotally connected to link 70 which has its lower end pivotally connected to the air foil 20. The connecting rod 64 extending from piston 62 undergoes only translational movement in correspondence to the movement of piston 62 but is pivotally connected to the lever arm 66 at a point close to fulcrum 68. Accordingly, upward or downward movement of piston 62 results in corresponding pivotal movement of lever arm 66 which in turn results in corresponding pivotal movement of the air foil 20. The proximity of the connection between rod 64 and lever arm 66 to fulcrum 68 allows relatively small movements of piston 62 to impart relatively large pivotal movement to air foil 20. FIG. 10 illustrates the air foil in three of its operational positions.

Turning now to FIGS. 5 through 8, another embodiment of the present invention is illustrated. Basically, this embodiment may be viewed as a dual type of module with respect to FIG. 2—that is, the embodiment in FIG. 6 includes back to back heat transfer apparatus sharing a common exhaust portion of an air duct and a common propeller.

Figure 6:
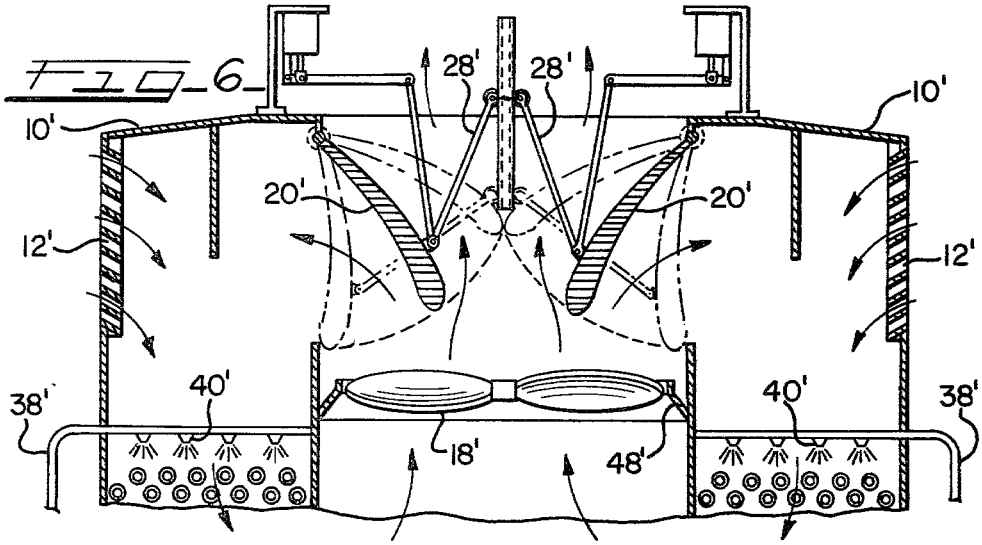
FIG. 6 is an elevational view, partly in section, as taken about on line 6—6 of FIG. 5.
Figure 7:
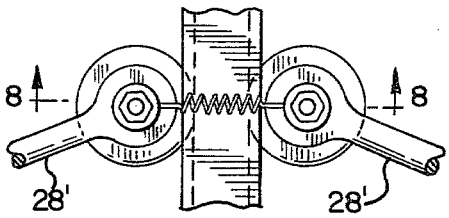
FIG. 7 is a detail view, similar to FIG. 3, with portions broken away, illustrating a joined pair of guide bar assemblies for use wwith the two dampers illustrated in FIG. 6.
Figure 8:
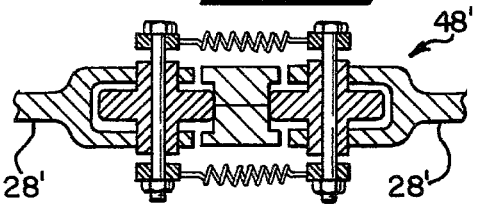
FIG. 8 is a top view, partly in section, with portions broken away taken about on line 8—8 on FIG. 7.

In FIG. 6, housings 10' each include an inlet grate 12', spray conduits 38' and spray means 40'. Although not shown, the FIG. 6 embodiment would also include a water reservoir and a pump for supplying sprays 40' and a U-shaped air flow passage leading to propeller 18' which is surrounded by a propeller ring 48'. In this arrangement, a pair of air foils 20' are disposed downstream of propeller 18' and operate in a manner as described with respect to air foil 20. In this regard, guide bars 28' are provided to guide the pivotal movement of the air foils. As shown in FIGS. 7 and 8, the guide bars 28' translate along a vertical guide post by means of a related roller assembly 48'. It is also to be noted in FIG. 5 that the dual module embodiment of the heat transfer apparatus could also include or be assembled with additional dual modules in a side by side relationship along the entire length of the tube bundle.

In operation of the first embodiment described, which is necessarily similar to the embodiment of FIGS. 5 through 8, as the temperature of the liquid passing through the tube bundle 16, for example, continues to decrease, a controller will signal the air foil actuator to position the air foil towards the horizontal, thereby reducing the amount of air exhausted at 22 and increasing the amount of air recirculated at 24 by gradually closing the exhaust port and opening the recirculation port in equal proportions. As less air is exhausted, the amount of air entering from the outside through port 12 will be reduced correspondingly. Infiltration of excess outside air through port 12 will be impeded by the baffle 14. This baffle is particularly useful with respect to any wind pressure against the grate or port 12.

If no cooling were required, the air foil would be completely horizontal, closing the exhaust area 22 except for possible leakage, and causing all air to be recirculated at 24. During this mode of operation, no further cooling would take place and the fan would preferably be stopped. Most of the outside air infiltrating through the port 12, particularly in the event of wind pressure thereagainst, is confined to the space above the tube bundle 16. Thus, the tube bundle 16 will never be in the path of infiltrating outside air, a fact of particular importance in sub-freezing weather. Accordingly, the tube bundle 16, being substantially recessed below port 12, can be easily kept at an above-freezing temperature by any one of a variety of heating devices.

As indicated, the effectiveness of the above apparatus, during cooling, is increased when the surface of the tube bundle 16 is drenched whereby lower fluid temperatures within the tube bundle 16 may be reached with reduced amounts of fan energy. Since the water passing over the tube bundle tends to leave scale deposits on the metallic surface, the "blowdown" arrangement described above has been developed, and it has also been found advantageous to continuously spray the tube bundle surface since encrustations are promoted by occasional drying. The disclosed apparatus will tolerate a continuous and massive water cascade over the tube bundle even during very cold weather because a natural updraft of outside air will not be induced through the air duct in which the tube bundle is located. Although it may be necessary to add heat to the water during very cold weather, this can easily be done by the injection of steam or the immersion of electric heaters, for example, in sump 30.

From the foregoing, it is apparent that the objects of the present invention have been fully accomplished. By the disposition of a propeller fan in an area of the air duct free from air flow disturbances, maximum fan efficiency is realized. In this regard, it is desirable to use a propeller fan since it can handle large air volumes in a relatively efficient manner relative to other types of fans. In addition, use of a single air foil blade or damper to control recirculation of air drawn through the system by the propeller avoids or minimizes disturbance with respect to the propeller air flow and also avoids the need to coordinate other dampers therewith as in prior art systems. In addition, a unique actuating system is disclosed for selectively positioning the recirculation damper within the air duct means. In raising the air foil, the lift imparted by the actuator is aided by the aerodynamic lift developed over the upper surface of the air foil.

Having thus described and illustrated various embodiments of my invention, it will be understood that such description and illustration is by way of example only and that such modifications and changes as may suggest themselves to those skilled in the art are intended to fall within the scope of the present invention as limited only by the appended claims.

I claim:

1. A heat device for cooling a fluid, said device comprising:

housing means having an air duct means passing therethrough;

propeller means disposed in said air duct means, said propeller means being operative to draw a stream of air through said air duct means;

cooling means disposed in said air duct means upstream of said propeller means;

conduction means in operative connection with said cooling means for conducting fluid through said cooling means whereby said stream of air passing over said cooling means absorbs heat from said fluid being conducted through said cooling means;

recirculation means disposed downstream of said propeller means for selectively recirculating portions of said air stream in said air duct means downstream of said propeller means back to said air duct means at a point upstream of said cooling means, said recirculation means comprising a blade means of an air foil configuration pivoted about its trailing edge to be selectively positioned, to recirculate all, some or none of the air stream passing through said air duct means; and the air duct portions adjacent the upstream and downstream sides of said propeller means being of a substantially straight flow path configuration when said blade means is disposed to preclude recirculation of said air stream.

2. A heat exchange device, as set forth in claim 1, further including means for discharging and distributing a liquid over said cooling means to wet the exterior of said cooling means and to evaporate and absorb heat therefrom.

3. A heat exchange device, as set forth in claim 2, wherein said means for discharging water over said cooling means includes sump means for collecting liquid distributed over said cooling means and redistributing the same over said cooling means.

4. A heat exchange device, as set forth in claim 2, wherein liquid is discharged and distributed over said cooling means in a direction generally the same as the direction of the air stream flow through said air duct means whereby the discharge of liquid over said cooling means does not oppose the air stream flow through said air duct means.

5. A heat exchange device, as set forth in claim 1, further including actuating means for selectively positioning said blade means.

6. A heat exchange device as set forth in claim 5 wherein said actuating means includes a first link means having one end pivoted about a fixed point relative to said device, a second link means pivotally connected at each of its ends between the other end of said first link means and said blade means, and drive means having a selectively positioned drive element operably connected to said first link means to selectively pivot said first link means about said fixed point associated therewith so as to selectively position said blade means.

7. A heat exchange device as set forth in claim 6 wherein said drive element is connected to said first link at a point relatively close to said fixed pivot point associated therewith whereby relatively small movements of said drive element correspondingly result in relatively large movements of said blade means.

8. A heat exchange device, as set forth in claim 1, further including means for discharging and distributing a liquid over said cooling means to wet the exterior of said cooling means and to evaporate and absorb heat therefrom.

9. A heat exchange device, as set forth in claim 8, wherein liquid is discharged and distributed over said cooling means in a direction generally the same as the direction of the air stream flow through said air duct means whereby the discharge of liquid over said cooling means does not oppose the air stream flow through said air duct means.

10. A heat exchange device, as set forth in claim 1, wherein said air duct means is of a cross-sectional area along its length at least as great as the cross-sectional area of said propeller means.

11. A heat exchange device, as set forth in claim 10, wherein the flow path of said air duct means is of U-shaped configuration with said cooling means disposed in one leg of said air duct means and said propeller means disposed in the other leg of said air duct means.

12. A heat exchange device, as set forth in claim 11, further including means for discharging and distributing a liquid over said cooling means to wet the exterior of said cooling means and to evaporate and absorb heat therefrom.

13. A heat exchange device, as set forth in claim 12, wherein liquid is discharged and distributed over said cooling means in a direction generally the same as the direction of the air stream flow through said air duct means whereby the discharge of liquid over said cooling means does not oppose the air stream flow through said air duct means.

14. A heat exchange device for cooling a fluid, said device comprising:

housing means having an air duct means passing therethrough, propeller means disposed in said air duct means, said propeller means being operative to draw a stream of air through said air duct means, cooling means disposed in said air duct means upstream of said propeller means, conduction means in operative connection with said cooling means for conducting fluid through said cooling means whereby said stream of air passing over said cooling means absorbs heat from said fluid being conducted through said cooling means, an air foil recirculation means pivoted about its trailing edge and disposed downstream of said propeller means for selectively recirculating all, some or none of said air stream in said air duct means downstream of said propeller means back to said air duct means at a point upstream of said cooling means, and the air duct portions adjacent the upstream and downstream sides of said propeller means being so formed that air flow to and from said propeller means is substantially undisturbed when said air foil recirculation means is disposed to preclude recirculation of said air stream.

15. A heat exchange device, as set forth in claim 14, including actuating means for selectively positioning said air foil means.

16. A heat exchange device as set forth in claim 15, wherein said actuating means includes a first link means having one end portion pivoted about a fixed point relative to said device, a second link means pivotally connected between the other end of said first link means and said air foil means, and drive means having a selectively positioned drive element operatively connected to said first link means to selectively pivot said first link means about said fixed point associated therewith so as to selectively position said air foil means.

17. A heat exchange device, as set forth in claim 14, wherein said air duct means is of a cross-sectional area along its length at least as great as the cross-sectional area of said propeller means.

18. A heat exchange device, as set forth in claim 17, wherein the flow path of said air duct means is of U-shaped configuration with said cooling means disposed in one leg of said air duct means and said propeller means disposed in the other leg of said air duct means.

19. A heat exchange device for cooling a fluid, said device comprising:

housing means having a pair of air duct means passing therethrough, said pair of air duct means having a common exhaust portion, propeller means disposed in said common exhaust portion, said propeller means being operative to draw a stream of air through said pair of air duct means, cooling means disposed in each said air duct means upstream of said propeller means, conduction means in operative connection with each of said cooling means for conducting fluid through each of said cooling means whereby said streams of air respectively passing thereover absorb heat from said fluids being respectively conducted through said cooling means, recirculation means disposed downstream of said propeller means for selectively recirculating portions of said air stream in said common exhaust portion downstream of said propeller means back to said pair of duct means at points upstream of said cooling means, said recirculation means comprising a pair of blade means having air foil configurations pivoted about their trailing edges to be selectively positioned to recirculate all, some or none of the air stream passing through said common exhaust portion of said air duct means, and the air duct portions adjacent the upstream and downstream sides of said propeller means being of a substantially straight flow path configuration and said recirculation means and said portions of said air duct means adjacent said propeller means being so formed that air flow to and from said propeller means is substantially undisturbed when said blade means is disposed to preclude recirculation of said air stream.

20. A heat exchange device, as set forth in claim 19, wherein the flow path of each of said pair of air duct means is of U-shaped configuration with each said cooling means being correspondingly disposed in one leg of said air duct means and said propeller means being disposed in said common exhaust portion of said air duct means formed by common legs thereof.

21. A heat exchange device for cooling a fluid, said device comprising:

housing means having an air duct means passing therethrough;

propeller means disposed in said air duct means, said propeller means being operative to draw a stream of air through said air duct means;

cooling means disposed in said air duct means upstream of said propeller means;

conduction means in operative connection with the said cooling means for conducting fluid through said cooling means whereby said stream of air passing over said cooling means absorbs heat from said fluid being conducted through said cooling means;

recirculation means disposed downstream of said propeller means for selectively recirculating portions of said air stream in said air duct means downstream of said propeller means back to said air duct means at a point upstream of said cooling means, said recirculation means comprising an air foil means pivoted about its trailing edge for selectively recirculating all, some or none of the air stream flow through said air duct means;

the air duct portions adjacent the upstream and downstream sides of said propeller means being of a substantially straight flow path configuration when said air foil means is disposed to preclude recirculation of the air stream flow through said air duct means, and said air duct means being of a cross-sectional area along its length at least as great as the cross-sectional area of said propeller means wherein the flow path of said air duct means is of U-shaped configuration with said cooling means disposed in one leg of said air duct means and said propeller means disposed in the other leg of said air duct means;

means for discharging and distributing a liquid over said cooling means to wet the exterior of said cooling means and to evaporate and absorb heat therefrom; and an air inlet portion disposed at a substantial angle to said air duct leg portion in which said cooling means is disposed, and being in connection therewith, said inlet portion having a baffle means contacting air flowing through said inlet portion and directing the same for flow through said air duct means.

22. A heat exchange device for cooling a fluid, said device comprising:

housing means having an air duct means passing therethrough;

propeller means disposed in said air duct means, said propeller means being operative to draw a stream of air through said air duct means;

cooling means disposed in said air duct means upstream of said propeller means;

conduction means in operative connection with the said cooling means for conducting fluid through said cooling means whereby said stream of air passing over said cooling means absorbs heat from said fluid being conducted through said cooling means;

recirculation means disposed downstream of said propeller means for selectively recirculating portions of said air stream in said air duct means downstream of said propeller means back to said air duct means at a point upstream of said cooling means;

the air duct portions adjacent the upstream and downstream sides of said propeller means being of a substantially straight flow path configuration when said air foil means is disposed to preclude recirculation of the air stream flow through said air duct means, and said air duct means being of a cross-sectional area along its length at least as great as the cross-sectional area of said propeller means wherein the flow path of said air duct means is of U-shaped configuration with said cooling means disposed in one leg of said air duct means and said propeller means disposed in the other leg of said air duct means, and an air inlet portion disposed at a substantial angle to said air duct leg portion in which said cooling means is disposed, and being in connection therewith, said inlet portion having a baffle means contacting air flowing through said inlet portion and directing the same for flow through said air duct means.

23. A heat exchange device for cooling a fluid, said device comprising:

housing means having a pair of air duct means passing therethrough, said pair of air duct means having a common exhaust portion;

propeller means disposed in said common exhaust portion, said propeller means being operative to draw a stream of air through said pair of air duct means;

cooling means disposed in each said air duct means upstream of said propeller means wherein the flow path of said pair of each of air duct means is of U-shaped configuration with each said cooling means being correspondingly disposed in one leg of said air duct means and said propeller means being disposed in said common exhaust portion of said air duct means formed by common legs thereof;

conduction means in operative connection with each of said cooling means for conducting fluid through each of said cooling means whereby said streams of air respectively passing thereover absorb heat from said fluids being respectively conducted through said cooling means;

recirculation means disposed downstream of said propeller means for selectively recirculating portions of said air stream in said common exhaust portion downstream of said propeller means back to said pair of duct means at points upstream of said cooling means;

the air duct portions adjacent the upstream and downstream sides of said propeller means being of a substantially straight flow path configuration when said recirculation means is disposed to preclude recirculation of the air stream back to said pair of duct means; and a pair of air inlet portions correspondingly disposed at a substantial angle to said air duct leg portions in which said cooling means are disposed and being in connection therewith, each said inlet portion having a baffle means contacting air flowing through said inlet portion and directing the same for flow through said corresponding air duct means.

24. A heat exchange device for cooling a fluid, said device comprising:

housing means having an air duct means passing therethrough, propeller means disposed in said air duct means, said propeller means being operative to draw a stream of air through said air duct means, cooling means disposed in said air duct means upstream of said propeller means;

conduction means in operative connection with said cooling means for conducting fluid through said cooling means whereby said stream of air passing over said cooling means absorbs heat from said fluid being conducted through said cooling means, recirculation means disposed downstream of said propeller means for selectively recirculating portions of said air stream in said air duct means downstream of said propeller means back to said air duct means at a point upstream of said cooling means, said recirculation means comprising a blade means of an air foil configuration pivoted about its trailing edge to be selectively positioned, to recirculate all, some or none of the air stream passing through said air duct means, and an air inlet portion disposed at a substantial angle to said air duct leg portion in which said cooling means is disposed, and being in connection therewith, said inlet portion having a baffle means contacting air flowing through said inlet portion and directing the same for flow through said air duct means.

25. A heat exchange device as set forth in claim 24 wherein said air inlet portion is disposed in a substantially perpendicular manner to said air duct leg portion in which said cooling means is disposed.

* * * * *